US006592376B1

(12) United States Patent
Carpenter

(10) Patent No.: US 6,592,376 B1
(45) Date of Patent: Jul. 15, 2003

(54) DEVICE AND METHOD FOR GOLF TRAINING

(76) Inventor: Terry Carpenter, 30 Hillside Dr., Pacific, MO (US) 63069

( * ) Notice: Subject to any disclaimer, the term of this patent is extended or adjusted under 35 U.S.C. 154(b) by 39 days.

(21) Appl. No.: 09/590,739

(22) Filed: Jun. 8, 2000

(51) Int. Cl.[7] ..... A63B 69/36

(52) U.S. Cl. ..... 434/252; 473/267; 473/218; 473/257; 473/409

(58) Field of Search ..... 473/218, 257, 473/267, 409; 434/252; 273/DIG. 30, DIG. 21

(56) References Cited

U.S. PATENT DOCUMENTS

| | | | | |
|---|---|---|---|---|
| 4,181,307 A | | 1/1980 | Krene et al. | |
| 4,248,431 A | | 2/1981 | Burnes | |
| 4,355,810 A | * | 10/1982 | Rydeck | 473/218 |
| 4,915,387 A | * | 4/1990 | Baxstrom | 473/218 |
| 5,035,433 A | | 7/1991 | Durso | |
| 5,131,659 A | | 7/1992 | Lindberg, Jr. | 273/183 E |
| 5,163,686 A | | 11/1992 | Bergman | |
| 5,171,017 A | * | 12/1992 | Betancourt | 33/508 |
| 5,174,566 A | * | 12/1992 | Kelnhofer | 435/252 |
| 5,306,011 A | | 4/1994 | Perry | |
| 5,332,211 A | * | 7/1994 | Rife et al. | 273/DIG. 21 |
| 5,335,915 A | * | 8/1994 | Baudier | 473/218 |
| 5,348,304 A | | 9/1994 | Meade | |
| 5,464,220 A | * | 11/1995 | Hansen et al. | 473/218 |
| D365,619 S | | 12/1995 | Foster | |
| 5,842,931 A | * | 12/1998 | Payne | 273/DIG. 30 |
| 5,910,053 A | * | 6/1999 | Scalise | 473/257 |

FOREIGN PATENT DOCUMENTS

| | | | | |
|---|---|---|---|---|
| GB | 2130103 A | * | 5/1984 | A63B/69/36 |

* cited by examiner

*Primary Examiner*—Derris H. Banks
*Assistant Examiner*—Dmitry Suhol
(74) *Attorney, Agent, or Firm*—Husch & Eppenberger LLC; Dennis J M Donahue, III

(57) ABSTRACT

The invention is a golf training aid and a method of using the golf training aid. The face of the golf training aid is mirrored and permanently etched with several reference markings illustrating proper ball position, proper setup position, and proper club and body position at several points during the swing. The aid is marked for use with woods, irons, and the putter. In one embodiment of the invention, the reference markings include several lines and textual prompts. In another embodiment of the invention, the textual prompts and some of the lines are replaced by icons. The back of the golf training aid is flat, allowing it to sit flush on a practice surface, thus allowing the golfer to practice a golf swing with head down and eyes on the ball while simultaneously viewing his own image juxtaposed with markings for a proper swing. The aid is used by placing it on the practice surface along the target line and optionally securing it in position. The golfer then takes up proper setup position based on the body position reference markings on the face of the aid and swings based on the club position reference markings on the face of the aid. If desired, the golfer can have the face of the aid marked, either temporarily or permanently, with individualized markings for body position and club position.

25 Claims, 4 Drawing Sheets

DEVICE AND METHOD FOR GOLF TRAINING

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates generally to the sport of golf. More specifically, it relates to training aids for improving the golfer's swing by ensuring a consistently correct setup position and by improving the golfer's fundamentals during the swing.

BACKGROUND OF THE INVENTION

It is recognized that one can learn sports by comparing one's own performance to that of a model performer. In the sport of golf, one can improve one's own swing by comparing it to a proper swing. The proper swing can be demonstrated for the golfer desiring improvement and the golfer can attempt to mimic it, but certain elements of the proper swing can also be provided to the golfer in the form of reference markings on a training aid. By comparing his swing to the reference markings on the training aid, the golfer can improve his swing. The use of a training aid has the advantage of permanence, whereas a demonstration is fleeting and may be forgotten or incompletely learned.

Several existing golf training aids consist of mats marked with foot position, ball position, and/or club position at the start of the swing. These mats assist the golfer in taking a proper setup position, but they do not assist the golfer in performing a proper swing since they do not provide reference markings other than for setup. Other existing aids consist of mirrors or mat/mirror combinations that both indicate setup position and provide simultaneous feedback about the swing to the golfer in the form of a reflected image. Many of these mirrored aids include pictures of proper swings juxtaposed with the golfer's reflected image that can be used for comparison or reference lines for setup position on the mirrored surface. However, since many of these aids are vertical mirrors the golfer must look up to utilize the aid, thereby destroying correct setup posture with head down and eyes on the ball. Several of the mirrored aids teach a mirror that is angled towards the golfer so that the golfer's image is visible from knees up, a condition that is not necessary to practicing a proper swing. Furthermore, these aids do not provide positioning information throughout the entire swing, but rather only for setup; any pictures that are present for comparison represent a general, rather than a specific, comparison (that is, the golfer is required to compare appearance to appearance and not position to position). No existing aid provides positioning information throughout the entire swing (setup, backswing, and follow-through) for both club and body while executing a swing with head down and eyes on the ball.

SUMMARY OF THE INVENTION

It is in view of the above problems that the present invention was developed. The invention is a golf training aid and a method of using the golf training aid. The golf training aid has a mirrored face to provide simultaneous feedback to a golfer throughout the entire swing, and is permanently etched with reference markings indicating proper positioning at several points during the swing. These reference markings indicate proper setup position, proper ball position, and proper club and body position at several points during the swing. The mirrored face of the aid juxtaposes the golfer's image with the reference markings, allowing for an easy comparison and correction process. If desired, the face of the aid can be marked, either permanently or temporarily, with individualized reference markings for a particular golfer or club. The back of the aid is flat so that the aid will lie flat on a practice surface, thus allowing the golfer to receive the feedback provided by the aid with the golfer's head down and eyes on the ball, as is proper during a golf swing. The aid is marked for use with all clubs (drivers, irons, and putters), and can be used both indoors and outdoors, with or without a professional instructor.

In one embodiment of the invention, the reference markings are a plurality of lines and textual prompts permanently etched into the face of the aid. In another embodiment of the invention, the textual prompts and several of the lines are replaced by icons so that the aid can be understood by very young golfers and golfers with special needs (for example, learning disabled golfers).

The golf training aid is used by placing it on a practice surface with one edge parallel to the target line and optionally anchoring it to the practice surface. The golfer then assumes the setup position by comparing his image on the mirrored face of the aid to the permanent reference markings and making any necessary corrections. The golfer then swings, again comparing his image to the reference markings and making any necessary corrections. In addition, skilled golfers can utilize the aid when training on other, more advanced swing factors such as spine angle, posture, and swing plane.

It is an object of this invention to provide a golf training aid that provides the golfer with immediate feedback as to the correctness of the setup and entire swing and a simple method of making appropriate corrections based on that feedback.

It is another object of the present invention to provide a golf training aid that provides immediate feedback during a typical golf swing with head down and eyes on the ball.

It is yet another object of the present invention to provide a golf training aid that is customizable to individual golfers and specific clubs.

It is yet another object of the present invention to provide a training aid that satisfies the special needs of young or disabled golfers.

Further objects and advantages of the present invention will be apparent from the description below with reference to the accompanying drawings in which like numbers indicate like elements.

DETAILED DESCRIPTION OF THE INVENTION

Figure 1:
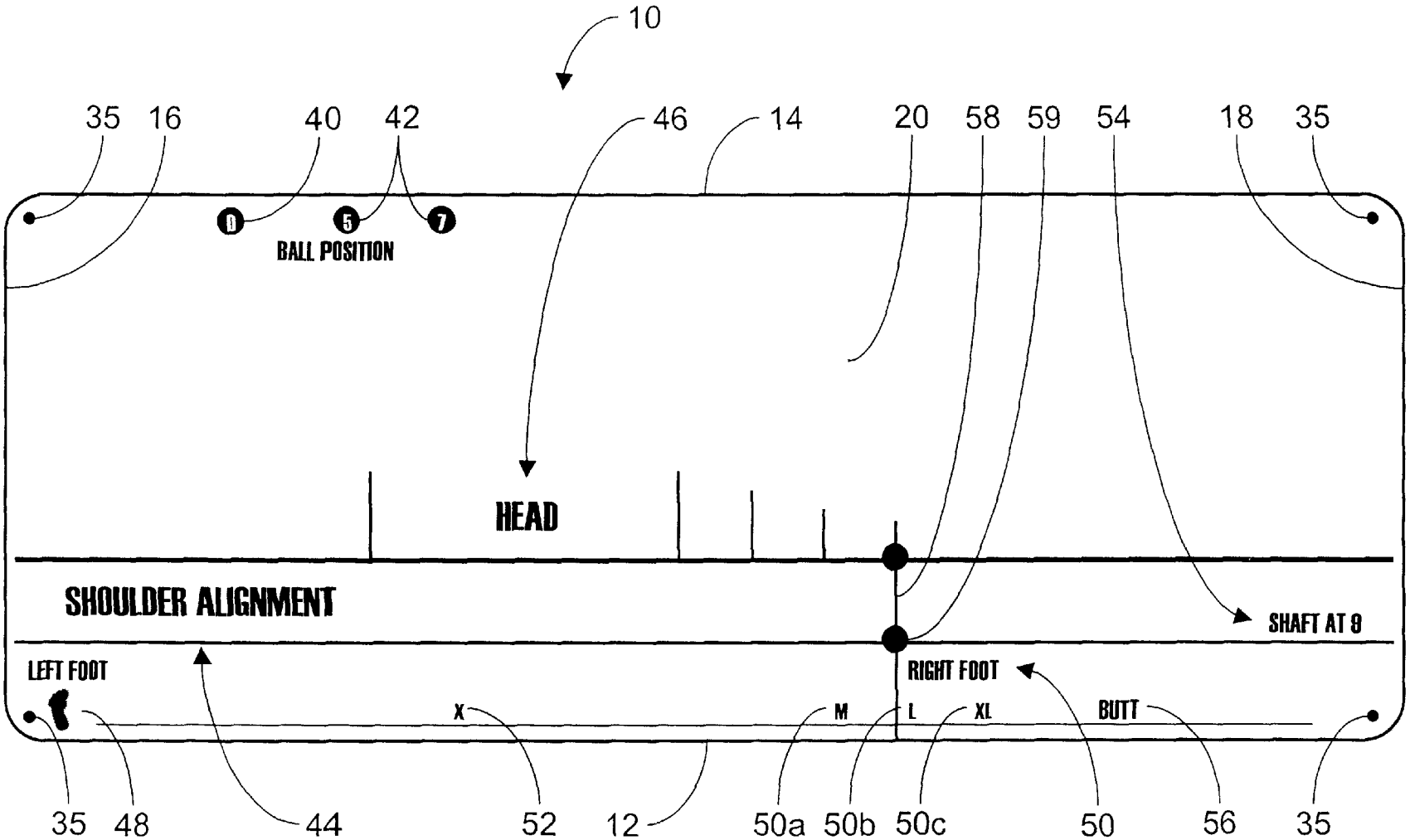
FIG. 1 is a top plan view of the golf training aid.
Figure 2:
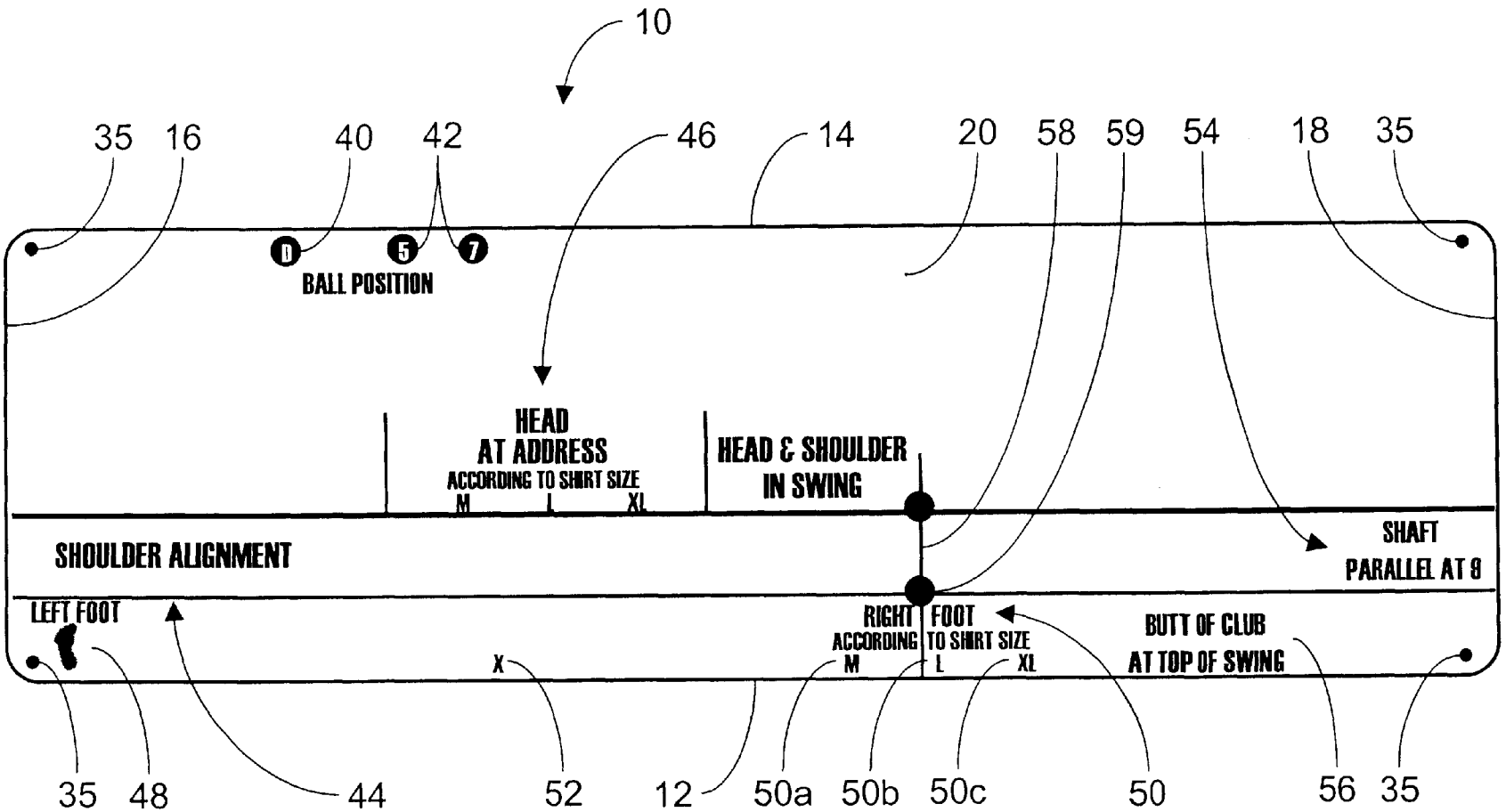
FIG. 2 is a top plan view of a smaller version of the golf training aid.

As illustrated by FIGS. 1 and 2, a golf training aid 10 of the present invention has the shape of a rectangle of varying dimensions, having long sides along a proximal edge 12 and a distal edge 14 and short sides along a forward edge 16 and a back edge 18. For one preferred embodiment, suitable for adult male golfers, the dimensions are approximately 32 inches by 12 inches. In a second preferred embodiment, suitable for women and junior golfers, the dimensions are approximately 30 inches by 8 inches. A front surface 20 is mirrored so that the golfer can view his image and position throughout the swing without lifting his head; this allows the golfer to compare himself to several reference markings on front surface 20 before and during the execution of a typical golf swing and make corrections accordingly. Front surface 20 may also be writable so that individualized reference lines may be added using permanent or temporary marker. A back surface 30 is flat, allowing golf training aid 10 to lie flat on the ground. In the preferred embodiments, golf training aid 10 is constructed of ⅛ inch mirrored plexiglass. If desired, golf tees can be placed through several tee holes 35, one in each corner, in order to anchor golf training aid 10 to the practice surface.

Golf training aid 10 provides the golfer with ball and body locating markings in order to assist the golfer in achieving a proper setup position. All of these markings are a permanent part of front surface 20 (for example, they may be etched thereon). Two ball locating markings, a driver marking 40 and an iron marking 42, located along distal edge 14 assist the golfer in positioning a ball for different types of clubs, with proper ball location moving closer to distal edge 14 and further to the right for higher numbered clubs. Driver marking 40 is 5½ inches from forward edge 16 in the adult male preferred embodiment and 7 inches from forward edge 16 in the women/juniors preferred embodiment; iron marking 42 is 11 inches from forward edge 16 in both preferred embodiments.

Several body locating markings assist the golfer in properly positioning his body. Several shoulder alignment lines 44 and several head and eye reference lines 46 help the golfer position the golfer's upper body, while a front foot locating marking 48 and several rear foot locating markings 50 help the golfer position the golfer's lower body. Shoulder alignment lines 44 extend 19 inches from forward edge 16 in both preferred embodiments, parallel to proximal edge 12 at 1, 3, and 5 inches therefrom in the adult male preferred embodiment and ¾, 2¾, and 4½ inches therefrom in the women/juniors preferred embodiment. Head and eye reference lines 46 are perpendicular to the most distal of shoulder alignment lines 44. Head and eye reference lines 46 occur at 8, 14, 15, 16, and 17 inches from forward edge 16 in the adult male preferred embodiment and at 8½, 13½, and 14½ inches in the women/juniors preferred embodiment; the head and eye reference lines 46 closer to back edge 18 position the golfer's head so that the golfer's weight is shifted to his rear leg. In both preferred embodiments, rear foot locating markings 50 are based on golfer shoulder width, one indication of which is shirt size (M, L, and XL). Front foot marking 48 is 1¼ inches from forward edge 16 in the adult male preferred embodiment and 2½ inches from forward edge 16 in the women/juniors preferred embodiment. A medium marking 50*a* is 17¼ inches from forward edge 16 in the adult male preferred embodiment; a large marking 50*b* and an extra large marking 50*c* follow in 1¾ inch increments. In the women/juniors preferred embodiment, medium marking 50*a* is 15½ inches from forward edge 16, with large marking 50*b* and extra large marking 50*c* following in 1½ inch increments.

Golf training aid 10 also assists the golfer in performing a proper swing by providing several club reference markings, also permanently placed onto front surface 20, that take the golfer through an entire swing. An initial point locating marking 52 along proximal edge 12, 11 inches from forward edge 16 in both preferred embodiments, helps the golfer position the butt of the club prior to starting the golf swing. Several swing reference lines 54 assist the golfer in maintaining proper club orientation during the swing, while a top of swing reference marking 56, 24½ inches from forward edge 16 in both preferred embodiments, locates the proper point for stopping the backswing and beginning the forward portion of the swing. In both preferred embodiments of the invention, swing reference lines 54 illustrate shaft orientation when the club is in the nine o'clock position (with the shaft of the club parallel to the ground), and top of swing reference marking 56 locates the butt of the club at the top of the swing. Swing reference lines 54 begin 19 inches from forward edge 16 and extend to back edge 18 in both preferred embodiments, running parallel to proximal edge 12 and at the same distances therefrom as shoulder alignment lines 44. Golf training aid 10 also provides a putter face reference line 58 and a ball icon 59 at the midpoint thereof, 19 inches from and parallel to forward edge 16 in both preferred embodiments, for use when putting.

Several textual prompts, also permanently placed onto front surface 20, serve to remind the golfer of the functions of the various reference lines and markings. For example, the word "butt" serves to locate top of swing reference marking 56, and further acts as a reminder that, at the top of the swing, the butt of the club should appear at that point on front surface 20. In addition to the permanently placed body, ball, and club reference lines described above, front surface 20 may also be writeable so that personalized reference or other markings or may be made.

Figure 3:
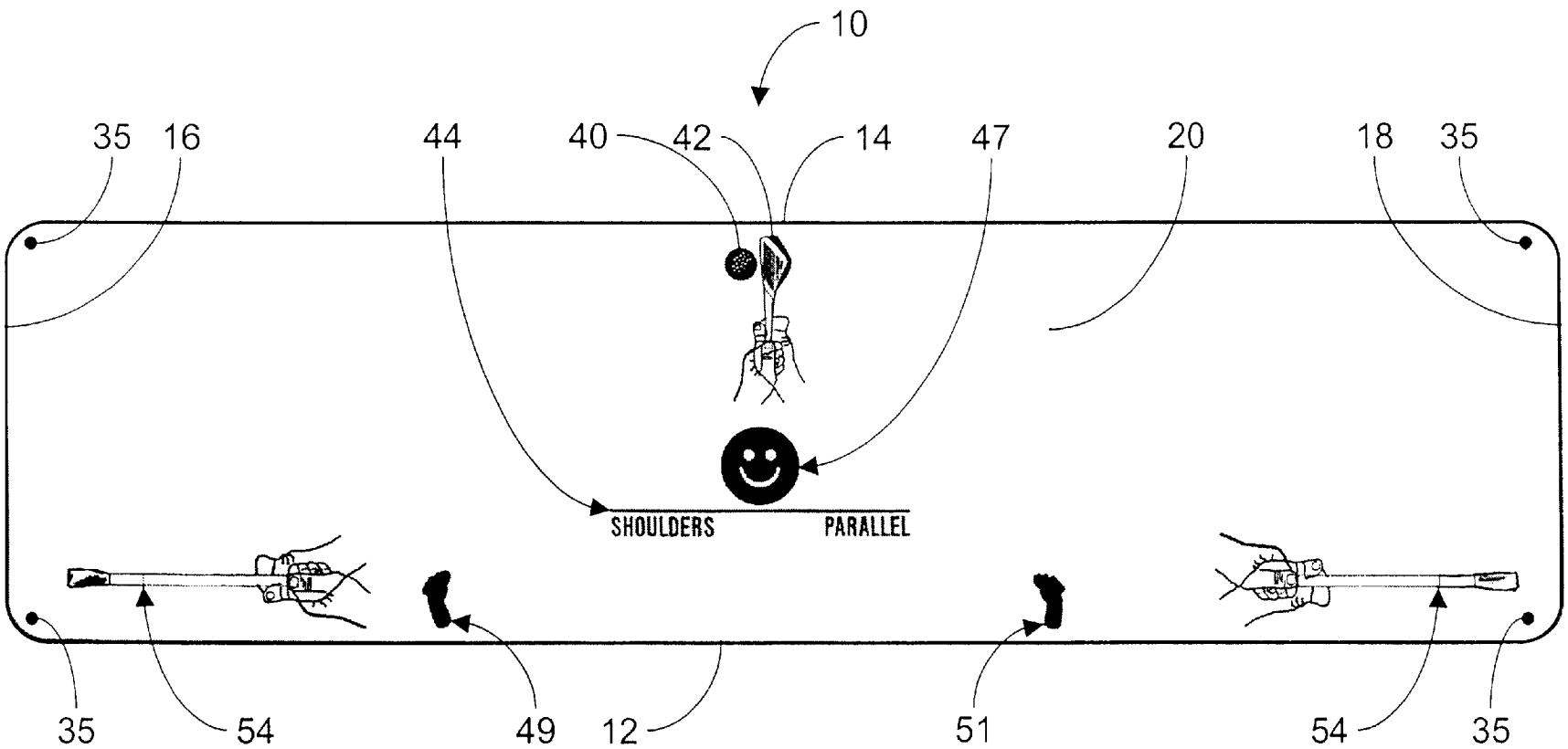
FIG. 3 is a top plan view of the simplified version of the golf training aid.

As shown in FIG. 3, golf training aid 10 may also be simplified by the use of icons instead of lines and textual prompts. This simplified golf training aid 10 particularly benefits very young golfers or special needs golfers (for example, those that are learning impaired). A front footprint icon 49 and a rear footprint icon 51 replace front foot locating marking 48 and rear foot locating markings 50 along proximal edge 12 to assist the golfer in positioning the golfer's feet. Head and eye reference lines 46 are replaced by a head and eye reference icon 47, and only one shoulder alignment line 44 is provided parallel to proximal edge 12. Additional icons may be provided, for example a club head icon for the end of the swing or a toe icon for the nine o'clock position. Also, additional footprint icons may be included to accommodate varying sizes of golfers, with different colors used to differentiate between the icons.

Figure 4:
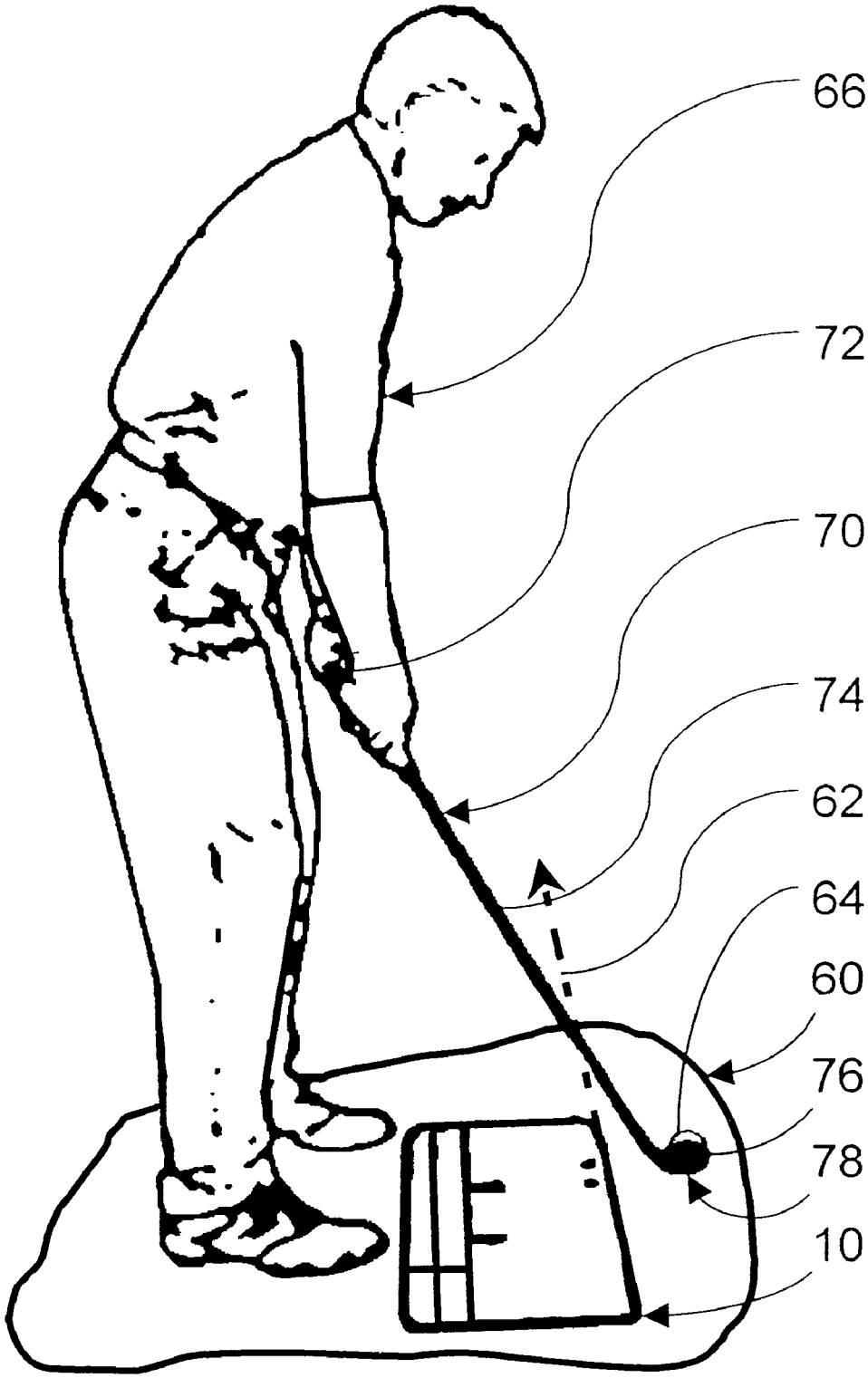
FIG. 4 is a perspective view of a golfer using the golf training aid.

The present invention also includes a method of using the golf training aid. Referring to FIG. 4, golf training aid 10 is first secured to a practice surface 60 with distal edge 14 parallel to a target line 62. If desired, golf training aid 10 can be anchored by placing golf tees through tee holes 35 and into practice surface 60 or by taping golf training aid 10 directly onto practice surface 60; the choice will depend on the nature of practice surface 60 (e.g. hard or soft, even or uneven), with the ultimate goal of having golf training aid 10 substantially flat on practice surface 60. Flat back surface 30 supports mirrored front surface 20 and maintains golf training aid 10 in a position substantially parallel to practice surface 60.

Once golf training aid 10 is positioned and secured, a ball 64 can be placed according to driver marking 40 for practice swings with a driver or according to iron marking 42 for practice swings with an iron. Ball 64 will move towards distal edge 14 and back edge 18 as club length decreases; if so desired, a club specific marking can be placed onto front surface 20 indicating the proper distance from forward edge 16 for ball 64. Alternatively, no ball needs to be placed if a golfer 66 wishes only to practice his swing.

After placing ball 64 (if desired) and taking proper grip on a club 70, golfer 66 then takes up proper position. Golfer 66 places his left foot one inch from proximal edge 12 at front foot locating marking 48 and his right foot one inch from proximal edge 12 at the appropriate rear foot locating marking 50 based on shoulder width, one indication of which is shirt size (M, L, or XL). The golfer's feet are therefore positioned at shoulder width with the toes defining a line parallel to and one inch from proximal edge 12. Golfer 66 then bows to the ball, positioning his shoulders parallel to shoulder alignment lines 44 and his head in the center of head and eye reference lines 46 or slightly to the right thereof if golfer 66 wishes to start with more of his weight shifted to his right leg. If desired, golfer 66 can use the most distal of shoulder alignment lines 44 to ensure that his eyes are parallel to his shoulders. Golfer 66 should slightly flex his knees over the balls of his feet, but his knees should not be visible on front surface 20; if the knees are visible on front surface 20, golfer 66 should straighten up until the knees disappear. At this point, the butt 72 of club 70 should appear on front surface 20 at initial point locating marking 52. By examining the juxtaposition of his own image with the various reference markings described above, golfer 66 can make the corrections required to conform to the reference markings, thus improving his setup position. If desired, individualized reference markings may be drawn directly on front surface 20. For example, a professional instructor could draw and label personalized eye, shoulder, or hand reference lines as well as a line indicating the position of the shaft of the club prior to the swing by tracing the desired reference on front surface 20 with either a permanent or temporary marker.

Golfer 66 then initiates his backswing by rotating his shoulders and torso to correct takeaway position. The golfer's hands should remain within shoulder alignment lines 44 until they reach rear foot locating marking 50. At the nine o'clock position, the shaft 74 of club 70 should be parallel to swing reference lines 54 with the toe 76 of club 70 pointed directly upwards, and the shoulders of golfer 66 should be at a 45 degree angle to shoulder alignment lines 44. At the top of the swing, butt 72 of club 70 should appear on front surface 20 at top of swing reference marking 56 with the shoulders nearly perpendicular to shoulder alignment lines 44; the club head 78 should not be visible on front surface 20. Again, golfer 66 can compare his image on front surface 20 with the various reference markings thereon engraved and make the corrections necessary to conform to those markings. Golfer 66 can then complete his swing. If desired, individualized reference markings may be drawn directly on front surface 20 at selected points during the swing. For example, a professional instructor could draw a line indicating the proper starting position for shaft 74 and a line indicating the position of shaft 74 when club 70 is in the nine o'clock position.

When putting, golfer 66 starts with the putter head between the most distal and the most proximal of swing reference lines 54 with the putter face parallel and adjacent to putter face reference line 58 as if preparing to strike ball icon 59. The golfer's feet will not be aligned according to front foot locating marking 48 and rear foot locating marking 50; however, the process by which golfer 66 assumes setup position will otherwise be similar to that described above. Golfer 66 then putts, attempting to keep the putter toe on the most distal of swing reference lines 54, the putter heel on the most proximal of swing reference lines 54, and putter face parallel to putter face reference line 58. In this manner, the swing reference lines are used for a golfer's putting stroke.

The method of using the simplified version of the golf training aid is generally similar to the method described above, with the principal difference that the reference lines and textual prompts described above have been replaced by icons. For example, instead of the process described above, golfer 66 positions his left foot according to front footprint icon 49, his right foot according to rear footprint icon 51, and his head and eyes according to head and eye icon 47. Golfer 66 will still position his shoulders parallel to shoulder alignment line 44.

Skilled golfers will also benefit from the golf training aid when it is utilized for more advanced functions. By placing golf training aid 10 squarely and vertically on one of the shorter edges, forward edge 16 or back edge 18, golfer 66 can check for proper posture. Shoulder alignment lines 44 should begin at the balls of the feet, continue vertically through the front of the kneecap, the rear of the right elbow, and into the rear portion of the right shoulder. In addition, golfer 66 can examine front surface 20 for a straight vertical line from the top of his right rear pant pocket to the heel of his right shoe indicating proper posterior position.

Golf training aid 10 can also be placed vertically on one of the shorter edges to check for proper swing plane. Golfer 66 takes his setup position with his toes appearing on front surface 20. Club 70 is then moved to the nine o'clock position with toe 76 pointed straight up or slightly closed. If shaft 74 of club 70 appears on a vertical line with the toes, judged by comparison to shoulder alignment lines 44, golfer 66 has achieved a proper takeaway position.

Golf training aid 10 also helps golfers to achieve proper spine angle when placed vertically and square on one of the shorter edges. Golfer 66 can check to see if there is a straight, vertical line from his right toe to his right ear by comparing his position to one or more of the reference lines parallel to proximal edge 12. If his right ear is to the right of the line, golfer 66 has broken spine angle by lifting up; if his right ear is to the left of the line, spine angle has been broken by dipping towards the ball.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawing shall be interpreted as illustrative rather than limiting. For example, although the drawings illustrate the golf training aid for right-handed golfers, it will be obvious to one skilled in the art that a mirror-image of the markings could be used for a left-handed golfer. Thus, the breadth and scope of the present invention should not be limited by any of the above-described exemplary embodiments, but should be defined only in accordance with the following claims appended hereto and their equivalents.

What is claimed is:

1. A planar golf training aid for use during a setup and a swing of a golf club on a practice surface, comprising:

a mirrored front surface having a proximal edge, a distal edge, a forward edge, and a back edge, wherein said edges define a rectangular shape with said proximal edge and said distal edge longer than said forward edge and said back edge;

a flat back surface supporting said mirrored front surface in a parallel relationship to the practice surface; and a plurality of permanent reference markings imprinted on said mirrored surface, said reference markings comprising a plurality of ball locating markings along said distal edge of said mirrored front surface, a front foot locating marking located along said proximal edge and toward said forward edge, and at least one rear foot locating marking located along said proximal edge and spaced from said front foot locating marking toward said back edge, wherein said ball locating markings along said distal edge are between said front foot locating marking and said rear foot locating marking.

2. The golf training aid according to claim 1, wherein said mirrored front surface and said flat back surface respectively consist of a front and a back of one rectangular mirror and wherein said reference markings further comprise:

a plurality of body reference markings; and a plurality of club position reference markings corresponding to selected points during the swing.

3. The golf training aid according to claim 2, wherein said ball locating markings further comprise a first ball locating marking for drivers and a second ball locating marking for irons, said second ball locating marking being spaced from said first ball locating marking toward said back edge, and further comprising a ball icon for putters, wherein said ball icon is located at a point closer to said proximal edge than said distal edge.

4. The golf training aid according to claim 2, wherein said body reference markings further comprise:

a plurality of shoulder alignment lines parallel to and near said proximal edge of said mirrored front surface; and a plurality of head and eye reference lines perpendicular to and extending toward said distal edge from the most distal of said shoulder alignment lines, said head and eye reference lines being located between said front foot locating marking and said rear foot locating marking.

5. The golf training aid according to claim 4, wherein said body reference markings further comprise a plurality of rear foot locating markings, said rear foot locating markings including an indication of size.

6. The golf training aid according to claim 2, wherein said body reference markings further comprise:

front and rear footprint icons distributed along said proximal edge of said mirrored front surface;

at least one swing reference line parallel to said proximal edge of said mirrored front surface and closer to said proximal edge than to said distal edge;

a shoulder alignment line parallel to said proximal edge of said mirrored front surface and located between said swing reference line and said distal edge; and a head and eye reference icon located between shoulder alignment line and said distal edge and between said front and rear footprint icons.

7. The golf training aid according to claim 2, wherein said club position reference markings further comprise:

an initial point reference marking located between said front foot locating marking and said rear foot locating marking;

a top of full swing reference marking located along said proximal edge at a point between said rear foot locating marking and said back edge; and a plurality of swing reference lines closer to said proximal edge than to said distal edge.

8. The golf training aid according to claim 7, wherein said swing reference lines further comprise at least one nine o'clock shaft position line parallel to and near said proximal edge of said mirrored front surface and a putter face reference line perpendicular to said nine o'clock shaft position line, said nine o'clock shaft position line extending from said front edge to said back edge and said putter face reference line perpendicular to and intersecting said nine o'clock shaft position line.

9. The golf training aid according to claim 1, further comprising means for removably securing said golf training aid to the practice surface such that said flat back surface lies flat on the practice surface.

10. A planar golf training device for use during a setup and full swing on a practice surface, including taking a club back to a top of the full swing and the setup including a front foot at a proximal edge of the golf training device, comprising:

a mirrored front surface having the proximal edge, a distal edge, a forward edge, and a back edge wherein said edges define a rectangular shape with said proximal edge and said distal edge longer than said forward edge and said back edge;

a flat back surface supporting said mirrored front surface in a substantially parallel relationship to the practice surface a plurality of permanent body reference markings on said mirrored front surface; and a plurality of permanent club position reference markings for selected points during the swing on said mirrored front surface, wherein the top of the full swing is indicated by a top of full swing reference marking.

11. The golf training aid according to claim 10, further comprising a plurality of permanent ball locating markings on said mirrored front surface along said distal edge of said mirrored front surface and a ball icon spaced from said ball locating markings.

12. The golf training aid according to claim 11, wherein said ball locating markings further comprise a ball locating marking for drivers and a ball locating marking for irons and wherein said ball icon is located for putters at a point closer to said proximal edge than said distal edge.

13. The golf training aid according to claim 12, wherein said body reference markings further comprise a shoulder alignment line and wherein said permanent club position reference markings further comprise a swing reference line and a putter face reference line, wherein said swing reference line is in a collinear relationship with said shoulder alignment line and wherein said putter face reference line extends from said proximal edge and is perpendicular to said swing reference line.

14. The golf training aid according to claim 10, wherein said body reference markings further comprise:

a front foot locating marking near the intersection of the proximal edge of said mirrored front surface and said forward edge of said mirrored front surface;

at least one rear foot locating marking along the proximal edge of said mirrored front surface and spaced from said front foot locating marking toward said back edge;

a plurality of shoulder alignment lines parallel to and near the proximal edge of said mirrored front surface; and a plurality of head and eye reference lines perpendicular to and extending toward said distal edge from the most distal of said shoulder alignment lines.

15. The golf training aid according to claim 14, wherein said body reference markings further comprise a plurality of rear foot locating markings, said rear foot locating markings including an indication of size.

16. The golf training aid according to claim 10, wherein said body reference markings further comprise:

front and rear footprint icons distributed along the proximal edge of said mirrored front surface;

at least one swing reference line parallel to the proximal edge of said mirrored front surface and closer to the proximal edge than to said distal edge;

a shoulder alignment line parallel to the proximal edge of said mirrored front surface and located between said swing reference line and said distal edge; and a head and eye reference icon located between shoulder alignment line and said distal edge and between said front and rear footprint icons.

17. The golf training aid according to claim 10, wherein said club position reference markings further comprise an initial point reference marking and a plurality of swing reference lines.

18. The golf training aid according to claim 17, wherein said top of full swing reference marking and said initial point reference marking is located along the proximal edge of said mirrored front surface, and said swing reference lines further comprise at least one nine o'clock shaft position line parallel to and near the proximal edge of said mirrored front surface and a putter face reference line perpendicular to said nine o'clock shaft position line, , said nine o'clock shaft position line extending from said front edge to said back edge and said putter face reference line perpendicular to and intersecting said nine o'clock shaft position line.

19. The golf training aid according to claim 18, further comprising means for removably securing said golf training aid to the practice surface such that said flat back surface lies flat on the practice surface.

20. A planar golf training aid for use during a setup and swing on a practice surface, comprising:

a mirrored front surface having a proximal edge, a distal edge, a forward edge, and a back edge;

a flat back surface supporting said mirrored front surface in a parallel relationship to the practice surface, wherein said mirrored front surface and said flat back surface respectively consist of a front and a back of one rectangular mirror; and a plurality of permanent reference markings imprinted on said mirrored surface, said reference markings comprising at least one shoulder alignment line collinear with at least one swing reference line and parallel to said proximal edge and a putter face reference line intersecting said swing reference line and perpendicular thereto.

21. The golf training aid according to claim 20, wherein said shoulder alignment line extends at least one foot between said forward edge and said back edge and equally bisects said putter face reference line.

22. The golf training aid according to claim 20, wherein said reference markings further comprise:

a ball icon located at said intersection between said swing reference line and said putter face reference line;

a plurality of body reference markings; and a plurality of club position reference markings corresponding to selected points during the swing.

23. The golf training aid according to claim 22, wherein said reference markings further comprise a plurality of ball locating markings along said distal edge of said mirrored front surface and wherein said body reference markings further comprise a front foot locating marking near the intersection of said proximal edge of said mirrored front surface and said forward edge of said mirrored front surface, at least one rear foot locating marking along said proximal edge of said mirrored front surface and spaced from said front foot locating marking toward said back edge, a plurality of shoulder alignment lines parallel to and near said proximal edge of said mirrored front surface, and a plurality of head and eye reference lines perpendicular to and extending toward said distal edge from the most distal of said shoulder alignment lines.

24. The golf training aid according to claim 20, wherein said edges define said rectangular mirror shape with long sides along the proximal edge and said distal edge and short sides along said forward edge and said back edge, and wherein said short sides are wider than a putter head and said long sides are more than twice as long as said short sides, and wherein said intersection between said putter face reference line and said swing reference line further comprises a ball icon.

25. The golf training aid according to claim 24, further comprising a tee hole at each corner of said rectangular shape, said regular shape being defined by a single mirrored sheet, wherein said short sides are wider than a putter head, and wherein said long sides are more than twice as long as said short sides, and wherein said intersection between said putter face reference line and said swing reference line further comprises a ball icon.

* * * * *